US006164912A

United States Patent [19]

Tabbita et al.

[11] Patent Number: 6,164,912

[45] Date of Patent: Dec. 26, 2000

[54] HOLLOW AIRFOIL FOR A GAS TURBINE ENGINE

[75] Inventors: Martin G. Tabbita; James P. Downs, both of Jupiter; Friedrich O. Soechting, Tequesta; Thomas A. Auxier, Palm Beach Gardens; Frederick Steinbauer, Jr., West Palm Beach, all of Fla.

[73] Assignee: United Technologies Corporation, Hartford, Conn.

[21] Appl. No.: 09/217,697

[22] Filed: Dec. 21, 1998

[51] Int. Cl.[7] ..... F01D 5/18

[52] U.S. Cl. ..... 416/97 R

[58] Field of Search ..... 416/96 R, 96 A, 416/97 R, 97 A; 415/115

[56] References Cited

U.S. PATENT DOCUMENTS

| | | | |
|---|---|---|---|
| 3,635,586 | 1/1972 | Kent et al. | 416/97 |
| 4,080,095 | 3/1978 | Stahl | 415/178 |
| 4,257,737 | 3/1981 | Andress et al. | 416/97 R |
| 4,684,322 | 8/1987 | Clifford et al. | 416/95 |
| 5,253,976 | 10/1993 | Cunha | 415/114 |
| 5,337,568 | 8/1994 | Lee et al. | 60/755 |
| 5,342,172 | 8/1994 | Coudray et al. | 416/97 R |
| 5,374,162 | 12/1994 | Green | 416/97 R |
| 5,486,093 | 1/1996 | Auxier et al. | 416/97 |
| 5,779,437 | 7/1998 | Abdel-Messeh et al. | 415/115 |

FOREIGN PATENT DOCUMENTS

924382A2 6/1999 European Pat. Off. .

OTHER PUBLICATIONS

U.S. application No. 08/992,322, Tabbita et al., filed Dec. 17, 1997.

U.S. application No. 08/992,323, Liang et al., filed Dec. 17, 1997.

U.S. Patent Application Serial No. 08/992,322, filed Dec. 17, 1997, entitled "Apparatus and Method for Cooling an Airfoil for a Gas Turbine Engine", inventors Martin G. Tabbita, James P. Downs, Friedrich O. Soechting and Thomas A. Auxier., pp. 1–15, plus two sheets of drawings, assigned to United Technologies Corporation.

U.S. Patent Application Serial No. 08/992,323, filed Dec. 17, 1997, entitled "Airfoil with Leading Edtge Cooling", inventors George P. Liang and Thomas A. Auxier, pp. 1–9, plus two sheets of drawings, assigned to United Technologies Corporation.

Copy of U.S. Patent Application No. 09/480,956, 15 pages specification/claims/abstract, 2 sheets drawings.

*Primary Examiner*—Edward K. Look
*Assistant Examiner*—Ninh Nguyen
*Attorney, Agent, or Firm*—Richard D. Getz

[57] ABSTRACT

A hollow airfoil is provided which includes a body having an external wall and an internal cavity. The external wall includes a suction side portion and a pressure side portion. The portions extend chordwise between a leading edge and a trailing edge and spanwise between an inner radial surface and an outer radial surface. A stagnation line extends along the leading edge. A plurality of cooling apertures, disposed spanwise along the leading edge. According to one aspect of the present invention, the apertures extend through the external wall along a helical path. According to another aspect of the present invention, the apertures are alternately directed towards the suction side portion and the pressure side portions of the airfoil.

10 Claims, 3 Drawing Sheets

FIG.1
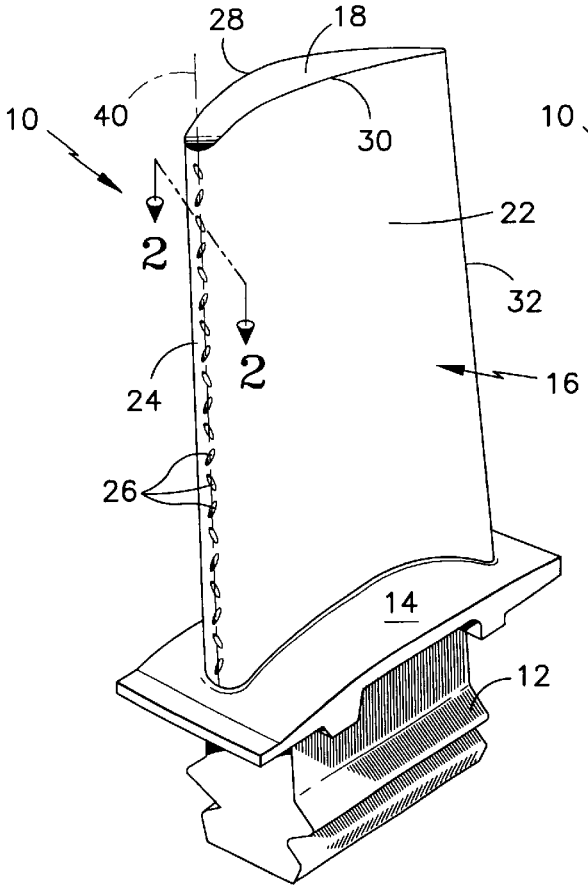
FIG.3
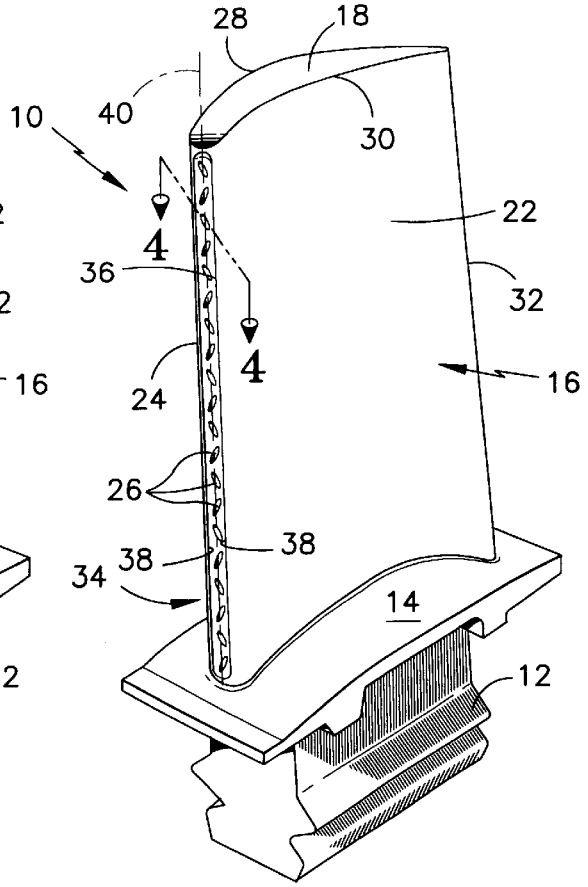
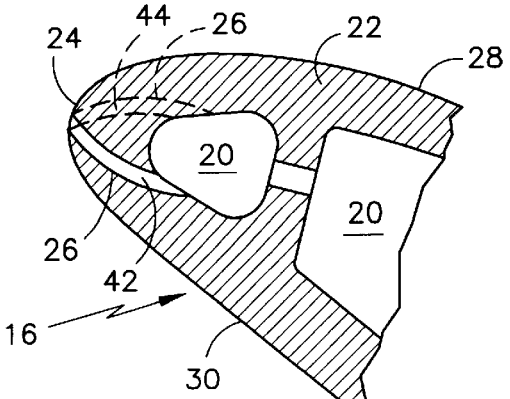
FIG.2
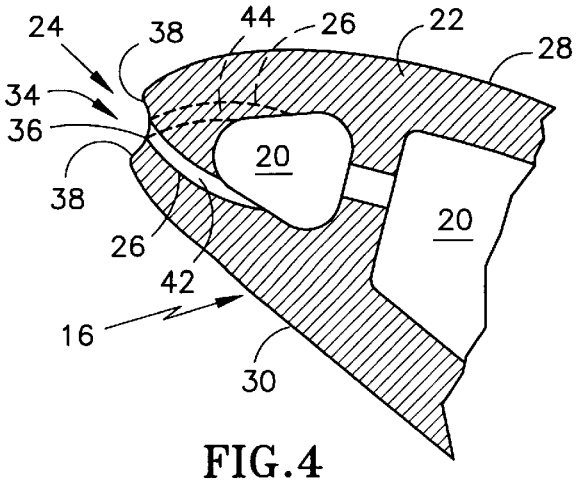
FIG.4

FIG.9
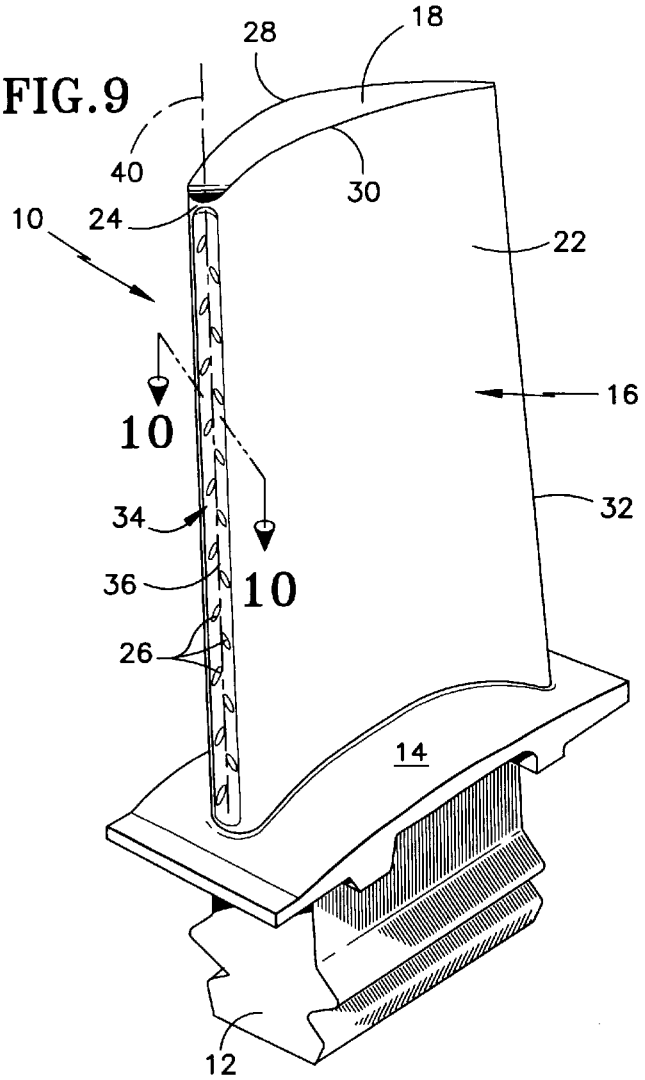
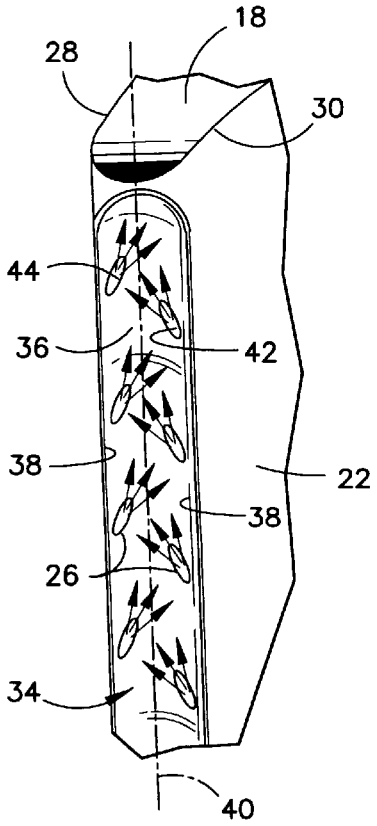
FIG.11
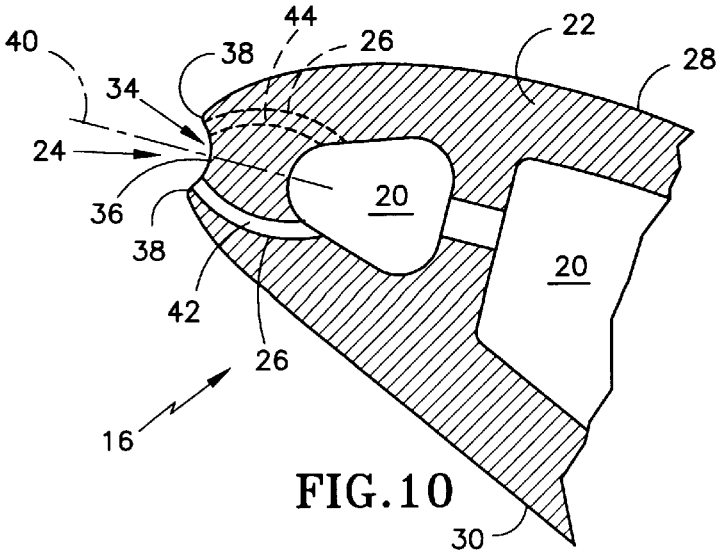
FIG.10

HOLLOW AIRFOIL FOR A GAS TURBINE ENGINE

BACKGROUND OF THE INVENTION

1. Technical Field

This invention relates to airfoils for gas turbines in general, and to hollow airfoils having apparatus for cooling the leading edge and establishing film cooling along the surface of the airfoil in particular.

2. Background Information

In the turbine section of a gas turbine engine, core gas travels through a plurality of stator vane and rotor blade stages. Each stator vane or rotor blade has an airfoil with one or more internal cavities surrounded by an external wall. The suction and pressure side portions of the external wall extend between the leading and trailing edges of the airfoil. Stator vane airfoils extend spanwise between inner and outer platforms and rotor blade airfoils extend spanwise between a platform and a blade tip.

High temperature core gas (which includes air and combustion products) encountering the leading edge of an airfoil will diverge around the suction and pressure side portions of the airfoil, with some of the gas impinging on the leading edge. The point along the airfoil where the velocity of the core gas flow decelerates to zero (i.e., the impingement point) is referred to as the stagnation point. There is a stagnation point at every spanwise position along the leading edge, and collectively those points are referred to as the stagnation line. Air impinging on or adjacent the leading edge is subsequently diverted around either side of the airfoil. The precise location of each stagnation point along the leading edge is a function of the angle of incidence of the core gas relative to the chordline of the airfoil, for both rotor and stator airfoils. In addition to the angle of incidence, the stagnation point of a rotor airfoil is also a function of the rotational velocity of the airfoil and the velocity of the core gas. Given the curvature of the leading edge, the approaching core gas direction and velocity, and the rotational speed of the airfoil (if any), the location of the stagnation points along the leading edge can be readily determined by means well-known in the art. In actual practice, rotor speeds and core gas velocities vary depending upon engine operating conditions as a function of time and position along the leading edge. As a result, some movement of the stagnation points (or collectively the stagnation line) along the leading edge can be expected during operation of the airfoil.

Cooling air, typically extracted from the compressor at a temperature lower and pressure higher than the core gas passing through the turbine section, is used to cool the airfoils. The cooler compressor air provides the medium for heat transfer and the difference in pressure provides the energy required to pass the cooling air through the stator or rotor stage.

In many cases, it is desirable to establish a film of cooling air along the surface of the stator or rotor airfoil by bleeding cooling air out of cooling holes. The term "bleeding" reflects the small difference in pressure motivating the cooling air out of the internal cavity of the airfoil. The film of cooling air traveling along the surface of the airfoil directs the flow of high thermal energy hot gas away from the airfoil, increases the uniformity of the cooling, and thermally insulates the airfoil from the passing hot core gas. A person of skill in the art will recognize, however, that film cooling is difficult to establish and maintain in the turbulent environment of a gas turbine.

A known method of establishing film cooling involves positioning cooling holes in or adjacent the leading edge of an airfoil in a "showerhead" arrangement. The showerhead typically includes a row of cooling holes on either side of the leading edge. The cooling holes are angled aft and are often diffused to facilitate film formation. In some cases, the showerhead includes a row of holes positioned directly on the leading edge. U.S. Pat. No. 5,374,162 discloses an example of such an arrangement.

One problem associated with using holes to create a cooling air film is the film's sensitivity to pressure difference across the holes. Too great a pressure difference across a cooling hole will cause the air to jet out into the passing core gas rather than aid in film formation. Too small a pressure difference will result in negligible cooling air flow through the hole, or worse, an in-flow of hot core gas. Both cases adversely affect film cooling effectiveness. Another problem associated with using holes to establish film cooling is that cooling air is dispensed from discrete points along the span of the airfoil, rather than along a continuous line. The gaps between cooling holes, and areas immediately downstream of those gaps, are exposed to less cooling air than are the holes and the spaces immediately downstream of the holes, and are therefore more susceptible to thermal distress. Another problem associated with using holes to establish film cooling is the stress concentrations that accompany each hole. Stress concentrations develop when loads (typically resulting from dynamic forces or thermal expansion) are carried by narrow expanses of material extending between adjacent holes. Film cooling effectiveness generally increases when the cooling holes are closely packed and skewed aft at a shallow angle relative to the external surface of the airfoil. Skewed, closely packed apertures, however, are more prone to stress concentrations.

Some prior art configurations have cooling holes disposed in the leading edge aligned with an average stagnation line, that extend perpendicular to the external surface of the airfoil. Such a cooling hole arrangement can experience an asymmetrical cooling air distribution. For example, an actual stagnation line shift to one side of a row of cooling holes can urge exiting cooling air to one side of the row, consequently leaving the opposite side starved of cooling air. The fact that the stagnation line can and does shift during airfoil operation illustrates that locating holes on the average stagnation line will not remedy all cooling air distribution problems. Cooling holes extending perpendicular to the external surface and skewed spanwise do not resolve the potential for asymmetrical cooling air distribution.

What is needed is an apparatus that provides adequate cooling along the leading edge of an airfoil, one that accommodates a variable position stagnation line, and one that promotes a uniform and durable cooling air film downstream of the leading edge on both sides of the airfoil.

DISCLOSURE OF THE INVENTION

It is, therefore, an object of the present invention to provide an airfoil having improved cooling along the leading edge.

It is another object of the present invention to provide an airfoil with leading edge cooling apparatus that promotes uniform and durable film cooling downstream of the leading edge on both sides of the airfoil.

It is still another object of the invention to provide an airfoil that can accommodate a variety of stagnation line positions.

According to the present invention, a hollow airfoil is provided which includes an external wall and an internal cavity. The external wall includes a suction side portion and a pressure side portion. The portions extend chordwise between a leading edge and a trailing edge and spanwise between an inner radial surface and an outer radial surface. A plurality of cooling apertures are disposed spanwise along the leading edge. The plurality of cooling apertures includes at least one aperture directed toward the suction side portion, such that cooling air exiting that cooling aperture is directed toward suction side portion, and another cooling aperture directed toward the pressure side portion, such that cooling air exiting that cooling aperture is directed toward the pressure side portion. In one embodiment, the cooling apertures are disposed along a spanwise-extending stagnation line. In a second embodiment, the cooling apertures are disposed adjacent the stagnation line. In both embodiments, the cooling apertures may be disposed within a trench extending along the leading edge.

An advantage of the present invention is that a film of cooling air having increased uniformity and durability downstream of the leading edge is provided on both sides of the airfoil. In some embodiments of the present invention, cooling air travels through apertures having spanwise and chordwise components. Cooling air exiting those apertures having spanwise and chordwise components dwells along the leading edge while traveling spanwise, but also travels chordwise to provide film coverage to the airfoil surfaces aft of the stagnation line. In those embodiments where cooling apertures are disposed in a trench, the cooling air dwells within the trench and subsequently bleeds out of the trench on both sides, helping to create continuous film cooling aft of the leading edge. The trench minimizes cooling losses characteristic of cooling apertures, and thereby provides more cooling air for film development and maintenance.

Another advantage of the present invention is that stress is minimized along the leading edge and areas immediately downstream of the leading edge. First, the present invention helps to minimize stress by increasing the spacing between adjacent apertures and thereby minimizes high stress regions. Second, the trench of cooling air that extends continuously along the leading edge minimizes thermally induced stress by eliminating the discrete cooling points separated by uncooled areas characteristic of conventional cooling schemes. The uniform film of cooling air that exits from both sides of the trench also minimizes thermally induced stress by eliminating uncooled zones between and downstream of cooling apertures characteristic of conventional cooling schemes.

Another advantage of the present invention is its ability to accommodate a variety of stagnation line positions. If a stagnation line moves to one side of a row of cooling holes extending perpendicular to the external surface, cooling air exiting those cooling holes will likely be urged to the side of the row opposite the stagnation line. As a result, the stagnation line side of the row will receive less and probably an insufficient amount of cooling air. The present invention avoids the effects of stagnation line movement by purposely directing cooling air toward both sides. In the most preferable embodiment, the trench is centered on the stagnation line which coincides with the largest heat load operating condition for a given application, and the width of the trench is preferably large enough such that the stagnation line will not travel outside of the side walls of the trench under all operating conditions. As a result, the present invention provides improved leading edge cooling and cooling air film formation relative to conventional cooling schemes.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a diagrammatic view of a rotor blade showing the present invention cooling apertures along the leading edge.

FIG. 2 is a partial sectional view of FIG. 1. Although this view shows the cooling apertures following a planar curved path, it may also be used to illustrate a planar view of the cooling apertures following a path having both chordwise and spanwise components.

FIG. 3 is a diagrammatic view of a rotor blade showing the present invention cooling apertures along the leading edge disposed in a trench.

FIG. 4 is a partial sectional view of FIG. 3. Although this view shows the cooling apertures following a planar curved path, it may also be used to illustrate a planar view of the cooling apertures following a path having both chordwise and spanwise components.

FIG. 9 is a diagrammatic view of a rotor blade showing the present invention cooling apertures along the leading edge, disposed in a trench. The cooling apertures are oriented to direct cooling air across the stagnation line.

FIG. 10 is a partial sectional view of FIG. 9. Although this view shows the cooling apertures following a planar curved path, it may also be used to illustrate a planar view of the cooling apertures following a path having both chordwise and spanwise components.

FIG. 11 is a partial view of FIG. 9, illustrating cooling air flow across the stagnation line within the trench.

BEST MODE FOR CARRYING OUT THE INVENTION

Figure 5:
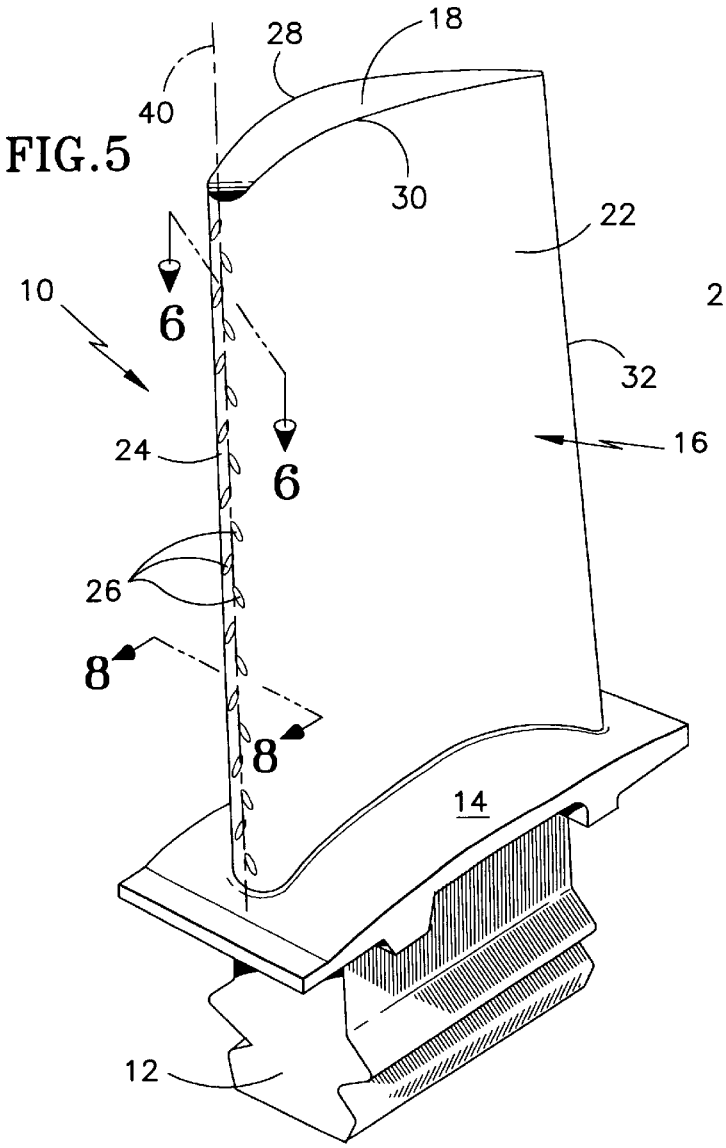
FIG. 5 is a diagrammatic view of a rotor blade showing the present invention cooling apertures along the leading edge. The cooling apertures are oriented to direct cooling air across the stagnation line.

Referring to FIGS. 1 and 2, a gas turbine engine turbine rotor blade 10 includes a root portion 12, a platform 14, an airfoil 16, and a blade tip 18. The airfoil 16 comprises one or more internal cavities 20 surrounded by an external wall 22, at least one of which is proximate the leading edge 24 of the airfoil 16, and a plurality of cooling apertures 26. The suction side portion 28 and the pressure side portion 30 of the external wall 22 extend chordwise between the leading edge 24 and the trailing edge 32 of the airfoil 16, and spanwise between the platform 14 and the blade tip 18. In the preferred embodiment, the airfoil 16 includes a trench 34 (see FIGS. 3, 4, and 9–11) disposed in the external wall 22, along the leading edge 24. The trench 34, which includes a base 36 and a pair of side walls 38, is preferably centered on a line 40 representative of the stagnation lines of the highest heat load operating conditions for a given application (hereinafter that line will be referred to as the "Stagnation Line"). The width of the trench 34 is preferably large enough such that all stagnation lines will fall between the side walls 38 of the trench 34 under all operating conditions. If it is not possible to provide a trench 34 wide enough to accommodate all possible stagnation line positions, then the width and the position of the trench 34 are chosen to accommodate the greatest number of stagnation lines that coincide with the highest heat load operating conditions. In all cases, the optimum position for the Stagnation Line 40 can be determined empirically and/or analytically.

Figure 7:
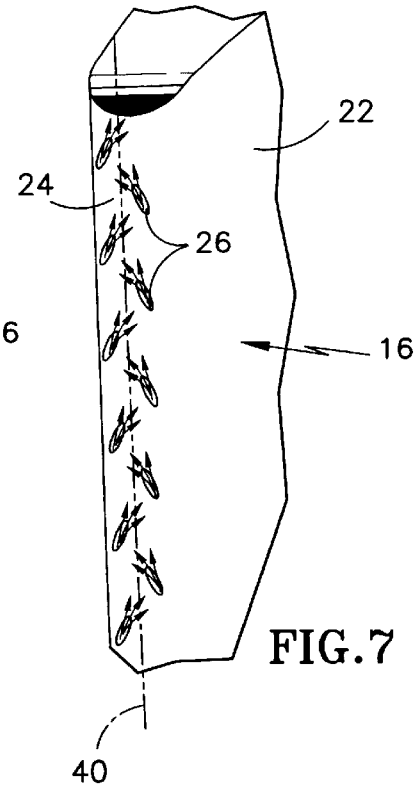
FIG. 7 is a partial view of FIG. 5, illustrating cooling air flow across the stagnation line.
Figure 8:
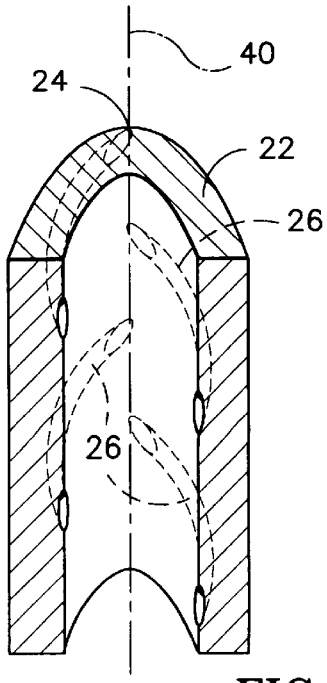
FIG. 8 is a partial sectional view of FIG. 5, showing aperture paths having chordwise and spanwise components.

The plurality of cooling apertures 26 are disposed along the leading edge 24, providing a passage through the external wall 22 for cooling air. The cooling apertures 26 include at least one first aperture 42 directed toward the suction side portion 28 and at least one second aperture 44 directed toward the pressure side portion 30. In most cases, however, there are a plurality of first and second cooling apertures 42,44 directed toward both the suction side portion 28 and the pressure side portion 30. In a first embodiment, the cooling apertures 26 are disposed along a spanwise extending line. The shape and position of that line substantially coincide with the Stagnation Line 40. In a second embodiment, the cooling apertures 26 are disposed adjacent the Stagnation Line 40. In the second embodiment, the first cooling apertures 42 (that direct cooling air toward the suction side portion 28) are disposed on the pressure side of the Stagnation Line 40, and the second cooling apertures 44 (that direct cooling air toward the pressure side portion 30) are disposed on the suction side of the Stagnation Line 40. In both embodiments the cooling apertures 26 preferably follow a curved path through the external wall 22. In all cases, the curved path may be described as having a chordwise component. In some cases, the curved path may be described as having both chordwise and spanwise components. A helical or spiral aperture path is an example of a path having chordwise and spanwise components. As can be seen in FIGS. 1, 3, 5,7–9, and 11, the cooling apertures 26 breaking through the exterior surface of the exterior wall 22 form elliptical (or nearly elliptical) shaped openings. In some applications, it may be advantageous to modify the opening into a diffuser-type opening (not shown).

Figure 6:
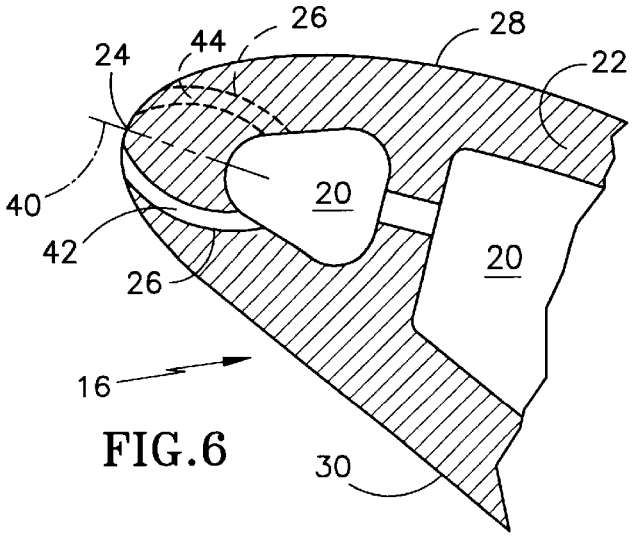
FIG. 6 is a partial sectional view of FIG. 5. Although this view shows the cooling apertures following a planar curved path, it may also be used to illustrate a planar view of the cooling apertures following a path having both chordwise and spanwise components.

In the operation of the invention, cooling air typically bled off of the compressor is routed into the airfoil 16 of the rotor blade 10 (or stator vane) by means well known in the art. Cooling air disposed within the internal cavity 20 proximate the leading edge 24 (see FIGS. 2,4,6 and 10) of the airfoil 16 is at a lower temperature and higher pressure than the core gas flowing past the external wall 22 of the airfoil 16. The pressure difference across the airfoil external wall 22 forces the cooling air to pass through the cooling apertures 26, exiting alternately toward the suction side portion 28 and the pressure side portion 30 of the airfoil 16. In the embodiment using cooling apertures 26 which follow a path having chordwise and spanwise components (e.g., helical), the spanwise component of the cooling air causes the air to travel in a spanwise direction as it exits the apertures 26, thereby advantageously increasing the dwell time of the cooling air along the leading edge 24. At the same time, the chordwise component of the cooling air flow insures adequate cooling across the leading edge 24.

In the embodiment with a trench 34, the cooling air exits the cooling apertures 26, alternately directed toward the suction side portion 28 and the pressure side portion 30 of the airfoil 16 within the trench 34. If the cooling apertures 26 follow the preferred path, the cooling air is directed alternately toward the opposite side walls 38 along lines having chordwise and spanwise components, thereby advantageously increasing the dwell time of the cooling air within the trench 34. Either way, the cooling air exits the apertures 26 and distributes within the trench 34, displacing spent cooling air already contained within the trench 34. The cooling air subsequently exits the trench 34 in a substantially uniform manner over the side walls 38 of the trench 34. The exiting flow forms a film of cooling air on both sides of the trench 34 that extends aft.

Although this invention has been shown and described with respect to the detailed embodiments thereof, it will be understood by those skilled in the art that various changes in form and detail thereof may be made without departing from the spirit and the scope of the invention. For example, FIGS. 2,4, 6–8, 10 and 11 show a partial sectional view of an airfoil. The airfoil may be that of a stator vane or a rotor blade.

We claim:

1. A hollow airfoil, comprising:

an internal cavity;

an external wall, which includes a suction side portion and a pressure side portion, wherein said portions extend chordwise between a leading edge and a trailing edge and spanwise between an inner radial surface and an outer radial surface;

wherein a stagnation line extends spanwise along said leading edge;

a plurality of cooling apertures extending through said external wall along a path having a chordwise component and a spanwise component, wherein said cooling apertures are disposed along a line substantially coinciding with said stagnation line, and substantially all of said cooling apertures thereby coincide with said stagnation line.

2. A hollow airfoil, further comprising:

an internal cavity;

an external wall, which includes a suction side portion and a pressure side portion, wherein said portions extend chordwise between a leading edge and a trailing edge and spanwise between an inner radial surface and an outer radial surface;

wherein a stagnation line extends spanwise along said leading edge;

a plurality of cooling apertures, coinciding with said stagnation line, said apertures extending through said external wall along path having a chordwise component and a spanwise component; and a trench, disposed in said external wall centered on said stagnation line, wherein said plurality of cooling apertures are disposed within said trench.

3. A hollow airfoil, comprising:

an internal cavity;

an external wall, which includes a suction side portion and a pressure side portion, wherein said portions extend chordwise between a leading edge and a trailing edge and spanwise between an inner radial surface and an outer radial surface;

wherein a stagnation line extends spanwise along said leading edge; and a plurality of cooling apertures, coinciding with said stagnation line, wherein said apertures are alternately directed towards said suction side portion and said pressure side portion, and thereby alternately direct cooling air toward said suction side portion and said pressure side portion.

4. A hollow airfoil, comprising:

an internal cavity;

an external wall, which includes a suction side portion and a pressure side portion, wherein said portions extend chordwise between a leading edge and a trailing edge and spanwise between an inner radial surface and an outer radial surface;

wherein a stagnation line extends spanwise along said leading edge; and a plurality of cooling apertures, coinciding with said stagnation line, wherein said apertures are alternately directed towards said suction side portion and said pressure side portion, and thereby alternately direct cooling air toward said suction side portion and said pressure side portion; and a trench, disposed in said external wall, extending in a spanwise direction, wherein said plurality of cooling apertures are disposed within said trench.

5. A hollow airfoil according to claim 4, wherein said apertures extend through said external wall along a curved path.

6. A hollow airfoil according to claim 5, wherein said curved path includes a chordwise component and a spanwise component.

7. A hollow airfoil, comprising:

an internal cavity;

an external wall, which includes a suction side portion and a pressure side portion, wherein said portions extend chordwise between a leading edge and a trailing edge and spanwise between an inner radial surface and an outer radial surface, and wherein a stagnation line extends spanwise along said leading edge;

at least one first cooling aperture, disposed adjacent said stagnation line, wherein said first cooling aperture is directed toward said suction side portion such that cooling air exiting said airfoil via said first cooling aperture is directed to pass over said stagnation line; and at least one second cooling aperture, disposed adjacent said stagnation line, wherein said second cooling aperture is directed toward said pressure side portion such that cooling air exiting said airfoil via said second cooling aperture is directed to pass over said stagnation line.

8. A hollow airfoil, comprising:

an internal cavity;

an external wall, which includes a suction side portion and a pressure side portion, wherein said portions extend chordwise between a leading edge and a trailing edge and spanwise between an inner radial surface and an outer radial surface, and wherein a stagnation line extends spanwise along said leading edge;

at least one first cooling aperture, disposed adjacent said stagnation line, wherein said first cooling aperture is directed toward said suction side portion such that cooling air exiting said airfoil via said first cooling aperture is directed to pass over said stagnation line; and at least one second cooling aperture, disposed adjacent said stagnation line, wherein said second cooling aperture is directed toward said pressure side portion such that cooling air exiting said airfoil via said second cooling aperture is directed to pass over said stagnation line; and a trench, disposed in said external wall, extending in a spanwise direction, wherein said first cooling aperture and said second cooling aperture are disposed within said trench.

9. A hollow airfoil according to claim 8, wherein said first cooling aperture and said second cooling aperture extend through said external wall along a curved path.

10. A hollow airfoil according to claim 9, wherein said first cooling aperture and said second cooling aperture extend through said external wall along a helical path.

* * * * *